US011138946B2

(12) United States Patent
Wang

(10) Patent No.: US 11,138,946 B2
(45) Date of Patent: Oct. 5, 2021

(54) DRIVING METHOD, DRIVING CIRCUIT AND DISPLAY DEVICE

(71) Applicant: HKC CORPORATION LIMITED, Shenzhen (CN)

(72) Inventor: Mingliang Wang, Chongqing (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 16/982,544

(22) PCT Filed: Nov. 23, 2018

(86) PCT No.: PCT/CN2018/117090

§ 371 (c)(1),
(2) Date: Sep. 19, 2020

(87) PCT Pub. No.: WO2020/093466

PCT Pub. Date: May 14, 2020

(65) Prior Publication Data

US 2021/0110779 A1 Apr. 15, 2021

(30) Foreign Application Priority Data

Nov. 9, 2018 (CN) ..... 201811331789.3

(51) Int. Cl.
*G09G 3/36* (2006.01)

(52) U.S. Cl.
CPC ... *G09G 3/3648* (2013.01); *G09G 2310/0291* (2013.01); *G09G 2320/02* (2013.01)

(58) Field of Classification Search
None
See application file for complete search history.

(56) References Cited

U.S. PATENT DOCUMENTS

| | | | | |
|---|---|---|---|---|
| 9,330,624 | B1 * | 5/2016 | Pei | G09G 3/3696 |
| 2004/0041778 | A1 * | 3/2004 | Hiraki | G09G 3/3688 345/100 |
| 2018/0033384 | A1 * | 2/2018 | Kim | G09G 3/3614 |
| 2018/0082650 | A1 * | 3/2018 | Li | G09G 3/3614 |
| 2019/0088228 | A1 * | 3/2019 | Lee | G09G 3/3688 |
| 2021/0005126 | A1 * | 1/2021 | Wang | G09G 3/3696 |

FOREIGN PATENT DOCUMENTS

| | | | |
|---|---|---|---|
| CN | 101211033 | A | 7/2008 |
| CN | 101398550 | A | 4/2009 |
| CN | 104217680 | A | 12/2014 |
| KR | 20070074736 | A | 7/2007 |
| KR | 20070094376 | A | 9/2007 |

OTHER PUBLICATIONS

Xiaolan Li, the ISA written comments, Jul. 2019, CN.
Xiaolan Li, the International Search Report, Jul. 2019, CN.

* cited by examiner

*Primary Examiner* — Aneeta Yodichkas

(57) ABSTRACT

The present application discloses a driving method, a driving circuit, and a display device. The driving circuit includes an initializer that outputs a common voltage, a compensator coupled to the initializer, and a controller that collects the common voltage output from the initializer, where when the common voltage is less than a preset threshold, the controller controls the compensator to compensate for a value of the common voltage.

19 Claims, 3 Drawing Sheets

DRIVING METHOD, DRIVING CIRCUIT AND DISPLAY DEVICE

CROSS REFERENCE OF RELATED APPLICATIONS

The present application claims priority to Chinese Patent Application No. CN 201811331789.3, filed with National Intellectual Property Administration, PRC on Nov. 9, 2018, and entitled "DRIVING METHOD, DRIVING CIRCUIT, AND DISPLAY DEVICE", which is incorporated herein by reference in its entirety.

TECHNICAL FIELD

The present application relates to the field of display technologies, and in particular, to a driving method, a driving circuit, and a display device.

BACKGROUND

The description herein merely provides background information related to the present application and does not necessarily constitute the prior art.

With the development and advancement of technology, a flat panel display has become a mainstream product of a display due to a thin body, power saving and low radiation, and has been widely applied. The flat panel display includes a thin film transistor-liquid crystal display (TFT-LCD) and an organic light-emitting diode (OLED) display. Among them, the thin film transistor-liquid crystal display controls the rotation directions of the liquid crystal molecules to refract the light of a backlight module to produce a picture, and has many advantages of thin body, power saving, no radiation, etc. The organic light-emitting diode display is made of an organic electroluminescent diode, and has many advantages of self-illumination, short response time, high definition and contrast, flexible display, large-area full-color display, etc.

Most of display panels on the market use a driving circuit originally developed, the control processes thereof are relatively simple, and there is impedance inside the driving circuit. Since the resolution of the display panel is higher and higher and the size thereof is larger and larger, it is then impossible to ensure the display effect of the display panel.

SUMMARY

The present application provides a driving method, a driving circuit, and a display device that actively compensates for offset of a common voltage, and ensure a display effect.

To achieve the above object, the present application provides a driving method for application in a driving circuit, the driving circuit including a compensator and an initializer, the driving method including the steps of: acquiring, by the compensator, a common voltage at an output terminal of the initializer; comparing the value of the common voltage with a preset threshold; and compensating for the value of the common voltage according to a comparison result.

The present application further discloses a drive circuit, including: an initializer that outputs a common voltage; a compensator coupled to the initializer; and a controller that collects the common voltage output from the initializer and controls the compensator to compensate for a value of the common voltage after the common voltage is less than a preset threshold.

Optionally, the controller includes a first switch and a second switch, the first switch controls and is connected to the initial controller, and controls the initializer to operate normally when the collected common voltage is at least the preset threshold; the second switch controls and is connected to the compensator, and controls the compensator to operate and compensate for the value of the common voltage when the collected common voltage is less than the preset threshold.

Optionally, the controller includes a standard voltage circuit that provides a reference voltage and a third switch, a source electrode of the third switch is connected to the standard voltage circuit, a gate electrode of the third switch collects the common voltage output by the initializer, a drain electrode controls and is connected to the compensator; and the third switch controls the compensator to compensate for the value of the common voltage when the common voltage is less than the reference voltage.

Optionally, the controller further include a standard voltage circuit that provides a reference voltage and a third switch, a source electrode of the third switch is connected to the standard voltage circuit, a gate electrode of the third switch collects the common voltage output by the initializer, and a drain electrode of the third switch controls and is connected with the first switch and the second switch.

Optionally, the standard voltage circuit includes a first resistor and a second resistor connected in series between a high level supply voltage and a low level voltage, the source electrode of the third switch is connected between the first resistor and the second resistor; and at least one of the first resistor and the second resistor is an adjustable resistor.

Optionally, the standard voltage circuit includes a third resistor, one end of the third resistor is connected to the drain electrode of the third switch and the other end thereof is grounded.

Optionally, the initializer includes an initial memory storing an initial value of the common voltage; the compensator includes a compensation memory storing a compensation value of the common voltage; an output terminal of the compensation memory is coupled to an output terminal of the initial memory to compensate for an initial value of the common voltage.

Optionally, the initializer includes an initial memory storing an initial signal code of a value corresponding to an initial common voltage; a digital-to-analog converter that converts the initial signal code transmitted from the initial memory into an analog voltage; and an output current amplifier that outputs the common voltage; the output terminal of the initial memory is coupled to an input terminal of the digital-to-analog converter, and an output terminal of the digital-to-analog converter is coupled to an input terminal of the output current amplifier; an output terminal of the output current amplifier is the output terminal of the initializer; the compensator includes a compensation memory that stores a compensation signal code; an output terminal of the compensation memory is coupled to the input terminal of the digital-to-analog converter of the initializer, the output terminal of the initial memory is coupled to the input terminal of the digital-to-analog converter via the first switch, and the output terminal of the compensation memory is coupled to the input terminal of the digital-to-analog converter of the initializer via the second switch.

Optionally, the driving circuit includes a control chip; the initializer, the compensator, the first switch and the second switch are all arranged on the control chip; the standard voltage circuit, the third resistor, and the third switch are arranged outside the control chip.

The present application further discloses a display device, including a display panel, and the display panel includes a first substrate, a second substrate arranged opposite to the first substrate; an array layer formed on the first substrate; a common electrode formed on the second substrate; and the driving circuit as mentioned above.

Compared with the driving circuit used before, as the resolution of a liquid crystal panel is higher and higher and the size thereof is larger and larger, the current draw of the common electrode is larger and larger; since there is internal impedance within the driving circuit, the larger the current is, the more the common voltage drops, the common voltage is differently offset, which affects the display effect. At the same time, since the common voltage is also affected by the array layer, and the array layer is used for transferring data of a displayed picture, the common voltage is differently offset due to the difference of the displayed picture; one compensator is added to the improved driving circuit, to be coupled to the initializer, and the controller collects the common voltage output by the initializer; when the common voltage of the driving circuit drops more and more, that is, after the common voltage is less than the preset threshold, the compensator is controlled to compensate for the value of the common voltage, and actively compensate for the value of the common voltage according to a comparison result to reduce the offset, thereby ensuring the display effect.

BRIEF DESCRIPTION OF DRAWINGS

The drawings are included to provide further understanding of embodiments of the present application, which constitute a part of the specification and illustrate the embodiments of the present application, and describe the principles of the present application together with the text description. Apparently, the accompanying drawings in the following description show merely some embodiments of the present application, and a person of ordinary skill in the art may still derive other accompanying drawings from these accompanying drawings without creative efforts. In the accompanying drawings.

DETAILED DESCRIPTION

Figure 1:
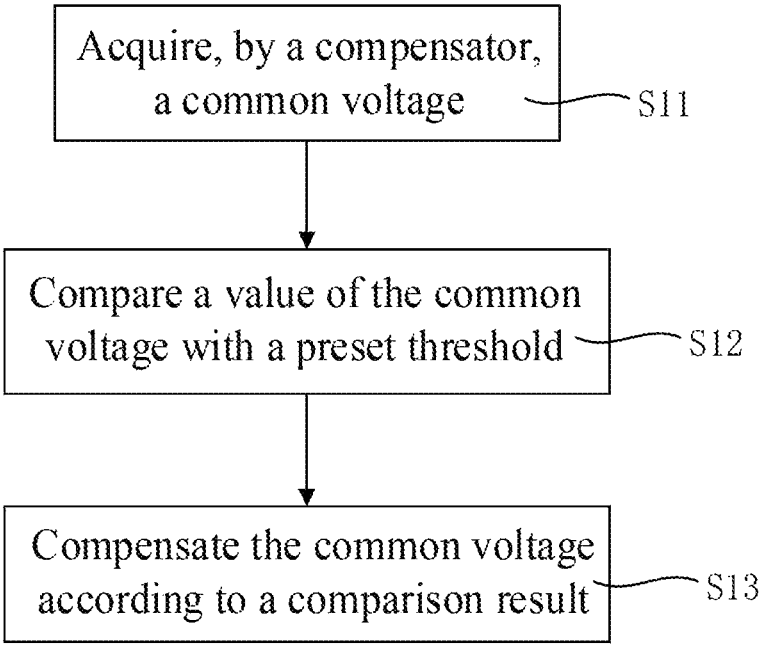
FIG. 1 is a schematic diagram of steps of a driving method of a display panel according to an embodiment of the present application.

The drawings are included to provide further understanding of embodiments of the present application, which constitute a part of the specification and illustrate the embodiments of the present application, and describe the principles of the present application together with the text description. Apparently, the accompanying drawings in the following description show merely some embodiments of the present application, and a person of ordinary skill in the art may still derive other accompanying drawings from these accompanying drawings without creative efforts. In the accompanying drawings:

The specific structure and function details disclosed herein are merely representative, and are intended to describe exemplary embodiments of the present application. However, the present application can be specifically embodied in many alternative forms, and should not be interpreted to be limited to the embodiments described herein.

In the description of the present application, it should be understood that, orientation or position relationships indicated by the terms "center", "transversal", "upper", "lower", "left", "right", "vertical", "horizontal", "top", "bottom", "inner", "outer", etc. are based on the orientation or position relationships as shown in the drawings, for ease of the description of the present application and simplifying the description only, rather than indicating or implying that the indicated device or element must have a particular orientation or be constructed and operated in a particular orientation. Therefore, these terms should not be understood as a limitation to the present application. In addition, the terms such as "first" and "second" are merely for a descriptive purpose, and cannot be understood as indicating or implying a relative importance, or implicitly indicating the number of the indicated technical features. Hence, the features defined by "first" and "second" can explicitly or implicitly include one or more features. In the description of the present application, "a plurality of" means two or more, unless otherwise stated. In addition, the term "include" and any variations thereof are intended to cover a non-exclusive inclusion.

In the description of the present application, it should be understood that, unless otherwise specified and defined, the terms "install", "connected with", "connected to" should be comprehended in a broad sense. For example, these terms may be comprehended as being fixedly connected, detachably connected or integrally connected; mechanically or electrically connected; or directly connected or indirectly connected through an intermediate medium, or in an internal communication between two elements. The specific meanings about the foregoing terms in the present application may be understood by those skilled in the art according to specific circumstances.

The terms used herein are merely for the purpose of describing the specific embodiments, and are not intended to limit the exemplary embodiments. As used herein, the singular forms "a", "an" are intended to include the plural forms as well, unless otherwise indicated in the context clearly. It will be further understood that the terms "comprise" and/or "include" used herein specify the presence of the stated features, integers, steps, operations, elements and/or components, but do not preclude the presence or addition of one or more other features, integers, steps, operations, elements, components and/or combinations thereof.

The present application is described in detail below with reference to the accompanying drawings and optional embodiments.

Figure 3:
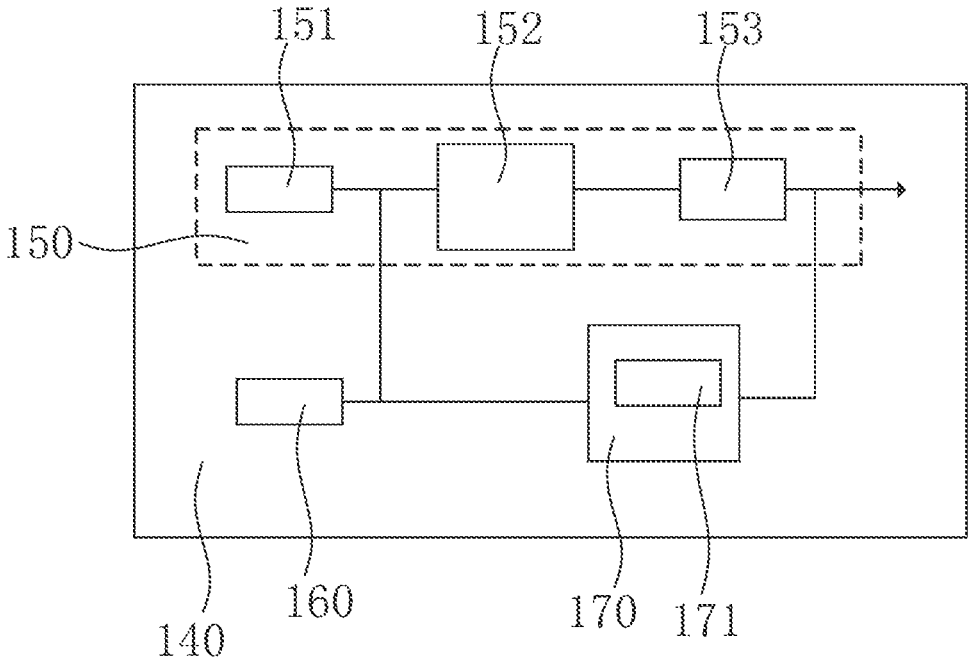
FIG. 3 is a schematic diagram of a driving circuit device according to an embodiment of the present application.

As shown in FIG. 1 and FIG. 3, an embodiment of the present application discloses a driving method, which is applied to a driving circuit 140, the driving circuit 140 includes a compensator 160 and an initializer 150, and the driving method includes steps of:

S11: Acquire by the compensator 160, a common voltage at an output terminal 154 of the initializer 150.

S12: Compare the value of the common voltage with a preset threshold.

S13: Compensate for the value of the common voltage according to a comparison result.

In this solution, the preset threshold is set by the inventor in the art according to a specific situation. If the value exceeds the preset threshold, it is considered that the common voltage exceeds a tolerance range, and compensation needs to be performed; the compensator 160 acquires the common voltage at the output terminal 154 of the initializer 150 and compares the value of the common voltage with the preset threshold; if the value of the common voltage is less than the preset threshold, compensation is performed for the common voltage; and if the value of the common voltage is equal to the preset threshold, the common voltage is output normally.

Figure 2:
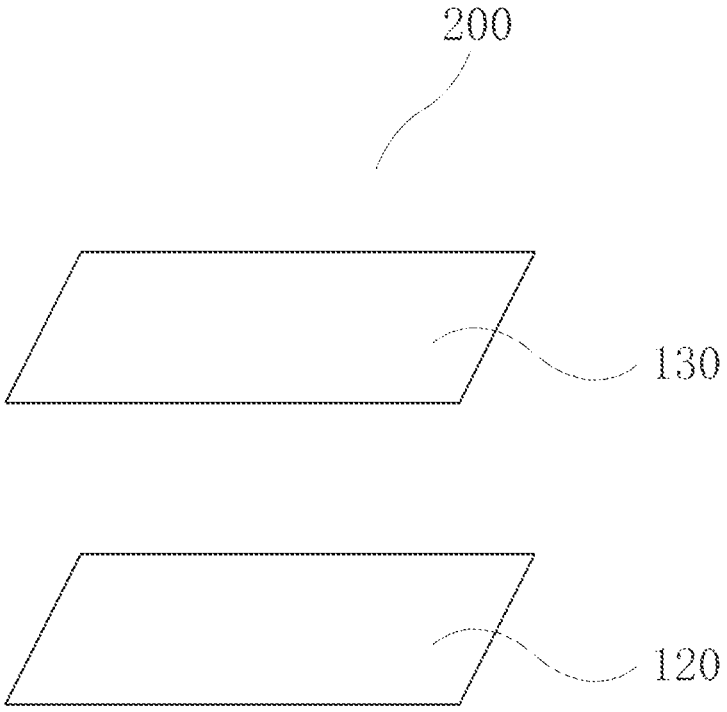
FIG. 2 is a schematic diagram of a liquid crystal display panel according to an embodiment of the present application.
Figure 4:
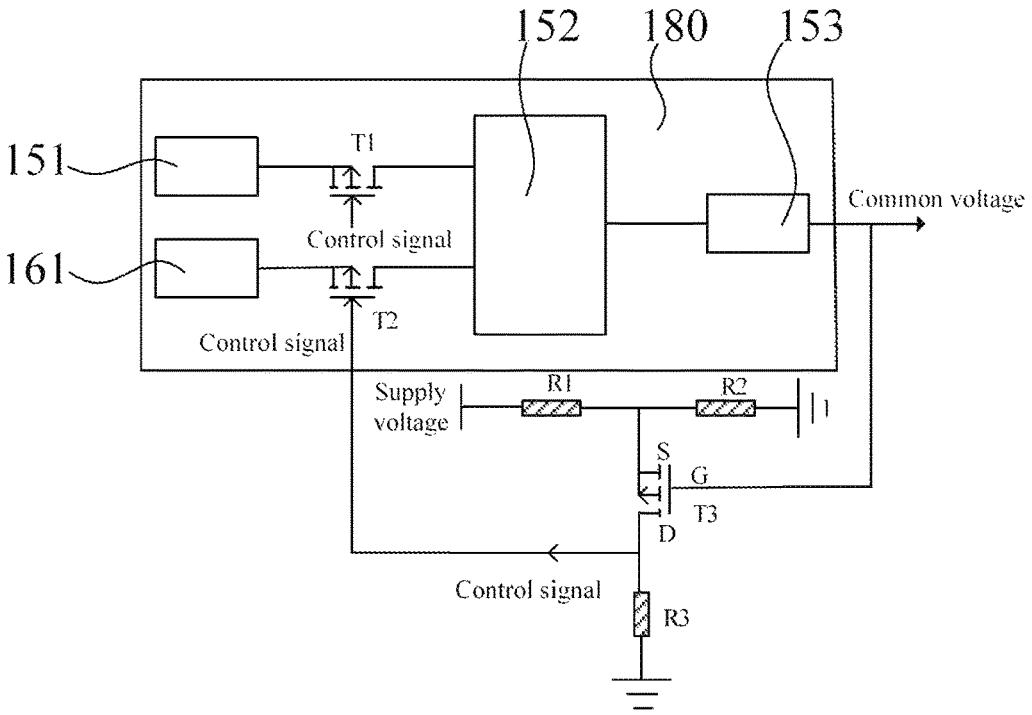
FIG. 4 is a schematic diagram of a driving circuit according to an embodiment of the present application.

As another embodiment of the present application, a driving circuit 140 is disclosed with reference to FIGS. 2 to 4; as shown in FIG. 3, the driving circuit 140 includes an initializer 150 that outputs a common voltage to a common electrode 130, a compensator 160 coupled to the initialize 150, and the controller 170 that collects the common voltage output by the initializer 150, and after the common voltage is less than a preset threshold, the compensator 160 is controlled to compensate for the value of the common voltage.

In this solution, as shown in FIG. 2, a liquid crystal panel is divided into an array layer 120 at a lower layer and the common electrode 130 at an upper layer, and the common voltage of the common electrode 130 at the upper layer is generally referred to as VCOM; as the resolution of the liquid crystal panel is higher and higher and the size thereof is larger and larger, the current draw of the common electrode 130 is larger and larger; since there is internal impedance within the driving circuit 140, as the current is larger and larger, the VCOM drops more. At the same time, because the VCOM is also affected by the array layer 120, and the array layer 120 is configured to transfer data of a displayed picture, the VCOM voltage is differently offset with the difference of the displayed picture; therefore, one compensator 160 is added and coupled to the initializer 150, and the controller 170 collects the common voltage output by the initializer 150; when the common voltage of the driving circuit 140 drops more and more, that is, after the common voltage is less than the preset threshold, the compensator 160 is controlled to compensate for the value of the common voltage, and actively compensate for the value of the common voltage according to the comparison result to reduce the offset, thereby ensuring the display effect.

Optionally, in this embodiment, the controller 170 includes a first switch T1 and a second switch T2, the first switch T1 controls and is connected to the initializer 150; when the collected common voltage is at least the preset threshold, the initializer 150 is controlled to normally operate; the second switch T2 controls and is connected to the compensator 160, and when the collected common voltage is less than the preset threshold, the compensator 160 is controlled to operate so as to compensate for the value of the common voltage.

The switch is generally a metal oxide semiconductor (MOS) field effect transistor. A switch with a control terminal being positive in polarity generally refers to a P-MOS tube, and a switch with a control terminal being negative in polarity generally refers to an N-MOS tube; of course, the switch may also be other device that implements a similar function; the control terminal of the first switch is negatively conductive while the control terminal of the second switch T2 is positively conductive.

In this solution, the switch is arranged mainly in the consideration of a main controller, because the main controller controls the switch-on/off of the first switch T1 and the second switch T2 by transmitting different level signals according to the comparison result, that is, it is determined whether the compensation is performed; when the collected common voltage is at least the preset threshold, the initializer 150 is controlled to operate normally; when the collected common voltage is less than the preset threshold, the compensator 160 is controlled to operate so as to compensate for the value of the common voltage; the switch is arranged to ensure that an initial memory 151 and the compensator 160 operate separately without affecting each other.

Optionally, in this embodiment, the controller 170 includes a standard voltage circuit and a third switch T3; the standard voltage circuit 171 provides a reference voltage; a source electrode S of the third switch is connected to the standard voltage circuit 171, a gate electrode G of the third switch collects the common voltage output by initializer 150, a drain electrode D controls and is connected to the compensator 160; and when the common voltage is less than a reference voltage, the third switch controls the compensator 160 to compensate for the value of the common voltage.

The switch is generally a metal oxide semiconductor (MOS) field effect transistor, a switch with a control terminal being positive in polarity generally refers to a P-MOS tube while a switch with a control terminal being negative in polarity generally refers to an N-MOS tube; of course, the switch may be other device that implements the similar function; and the control terminal of the third switch is negatively conductive.

In this solution, the controller 170 is provided therein with the standard voltage circuit 171, which mainly provides the reference voltage to be compared with the common voltage output by the initializer 150, and the third switch is the N-MOS; the source electrode is connected to the standard voltage circuit 171, the gate electrode collects the common voltage output by the initializer 150, and the drain electrode controls and is connected to the compensator 160; and when the common voltage is less than the reference voltage, the third switch controls the compensator 160 to compensate for the value of the common voltage.

Optionally, in this embodiment, the standard voltage circuit 171 includes a first resistor R1 and a second resistor R2 connected in series between a high level supply voltage VAA and a low level voltage, and a source electrode of the third switch is connected between the first resistor and the second resistor; at least one of the first resistor and the second resistor is an adjustable resistor, and the first resistor R1 and the second resistor R2 adjust the preset threshold.

In this solution, different compensation standards can be set by adjusting the first resistor and the second resistor, which is simple and easy; when the difference between the common voltage and the output voltage is small, that is, when the voltage is offset less, the resistance value of the first resistor can be adjusted to be large while the resistance value of the second resistor can be adjusted to be small, so that a relatively small compensated signal code can be used for completing the compensation, providing accuracy.

Optionally, in the embodiment, the standard voltage circuit includes a third resistor; as shown in FIG. 4, one end of the third resistor R3 is connected to a drain electrode of the third switch T3, and the other end thereof is grounded.

In this solution, if the drain electrode of the third switch is grounded, the obtained signal is always 0 volt, and then the control signal where the signal obtained by the switch 1 is 0 volt is always in a turned-on state, so the third resistor is arranged here; one end of the third resistor is connected to the drain electrode terminal of the third switch and the other end thereof is grounded so as to ensure that the control signal is not always 0 volt.

Optionally, in this embodiment, the initializer 150 includes the initial memory 151 that stores an initial value of the common voltage; the compensator 160 includes a compensation memory 161 that stores a compensation value of the common voltage; an output terminal of the compensation memory 161 is coupled to an output terminal of the initial memory 151 to compensate for the initial value of the common voltage.

In this solution, the initial memory has the initial value of the common voltage, and the compensation memory 161 stores the compensation value of the common voltage; the output terminal of the compensation memory 161 is coupled to the output terminal of the initial memory 151, and the controller 170 transmits a relevant signal; and after receiving the signal, the compensation memory 161 determines whether to compensate for the initial value of the common voltage.

Optionally, in this embodiment, the initializer 150 includes the initial memory 151 that stores an initial signal code of a value of to a corresponding initial common voltage, a digital-to-analog converter 152 that converts the initial signal code transmitted from the initial memory 151 into an analog voltage, and an output current amplifier 153 that outputs the common voltage; the output terminal of the initial memory 151 is coupled to an input terminal of the digital-to-analog convener 152, and an output terminal of the digital-to-analog converter 152 is coupled to an input terminal of the output current amplifier 153; the output terminal 154 of the output current amplifier 153 is namely the output terminal 154 of the initializer 150; the compensator 160 includes the compensation memory 161 that stores a compensation signal code; the output terminal of the compensation memory 161 is coupled to the input terminal of the digital-to-analog converter 152 of the initializer 150; the output terminal of the initial memory 151 is coupled to the input terminal of the digital-to-analog converter 152 via the first switch, and the output terminal of the compensation memory 161 is coupled to the input terminal of the digital-to-analog converter 152 of the initializer 150 via the second switch.

In this solution, when the common voltage is offset, the controller 170 recognizes the offset in the first time and makes a determination; if the difference between the output voltage and the common voltage is too large and the common voltage is too low, the controller 170 begins to use the compensation signal code stored in the compensation memory 161, and the compensation signal code with a large value is stored therein, that is, by the increase in the signal code, compensation is performed for a voltage drop caused by the current draw of a back-end load.

Optionally, in this embodiment, the driving circuit 140 includes a control chip 180; the initializer 150, the compensator 160, the first switch T1, and the second switch T2 are all arranged on the control chip 180; and the standard voltage circuit, the third resistor R3 and the third switch T3 are arranged outside the control chip 180.

In this solution, a correlator on the control chip 180 is implemented mainly by cooperating with an external circuit; different control signal states obtained by the common voltage are utilized to switch the initial memory 151 and the compensation memory 161, and the circuit is simple and easy to realize.

As another embodiment of the present application, with reference to FIG. 4, different from the above embodiment, the controller 170 further includes:

- a standard voltage circuit 171 that provides the reference voltage;
- a third switch T3, where a source electrode of the third switch is connected to the standard voltage circuit, a gate electrode of the third switch collects the common voltage output by the initializer 150, and the drain electrode of the third switch controls and is connected to the first switch and the second switch.

The switch is generally a metal oxide semiconductor (MOS) field effect transistor (MOS), and a switch with the control terminal being positive in polarity generally refers to a P-MOS tube, while a switch with the control terminal being negative in polarity generally refers to an N-MOS tube; of course, the switch may be other device that implements the similar function, and the control terminal of the third switch is negatively conductive.

In this solution, as shown in FIG. 4, the common voltage output by the initializer 150 is collected back to the gate electrode G of the third switch T3, that is, a gate voltage Vg is equal to the common voltage output by the initializer 150, and the voltage at the source electrode of T3 is obtained by dividing the supply voltage VAA by the first resistor R1 and the second resistor R2; a source voltage Vs is equal to the supply voltage multiplied by the value of the second resistor R2 and then divided by the sum of the first resistor R1 and the second resistor R2, that is, Vs=VAA*R2/(R1+R2); since T3 is the P-MOS tube, when Vg is less than Vs, T3 is conductive; and when the common voltage is lowered to a certain standard, T3 is conductive. After T3 is conductive, the voltage on T3 is switched from 0 volt to Vs=VAA*R2/(R1+R2), and the voltage on the third resistor R3 is named a control signal; this signal is connected to the gate electrodes of the first switch T1 and the second switch T3 inside a VCOM IC; since the first switch T1 is the P-MOS, the first switch is switched off; since the second switch is the N-MOS, the second switch is switched on; thus, the purpose of reducing the common voltage and then switching on the compensation memory 161 is achieved, and the compensation signal code with the larger value is stored in the compensation memory 161; and by the increase in the signal code, compensation is performed for the voltage drop caused by the current draw of the back-end load. When the output voltage is not offset or the offset thereof is small, if Vg is greater than Vs, and the third switch is not switched on, the voltage control signal of the third resistor R3 is 0 volt, so that the first switch is switched on, and the second switch is switched off; therefore, the signal code in the initial memory 151 is continuously used without affecting normal operation. The controller 170 actively compensates for the offset of the common voltage mainly by a hardware circuit, the different control signal states obtained by the common voltage are utilized to switch the initial memory 151 and the compensation memory 161, and the circuit is simple and easy to realize, which is simple and convenient, and is suitable for the drifting occasion of the common voltage.

Figure 5:
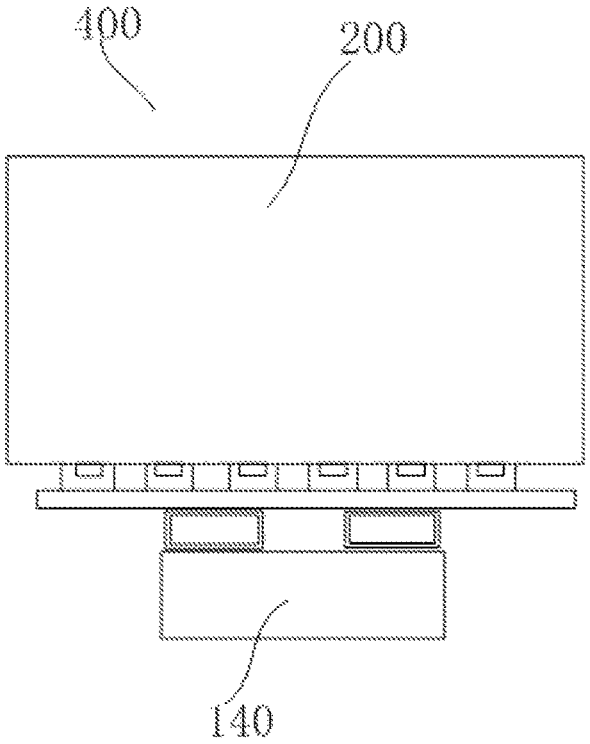
FIG. 5 is a schematic diagram of a display device according to an embodiment of the present application.

As another embodiment of the present application, with reference to FIG. 2 and FIG. 5, a display device 400 is provided and includes a display panel 200, and the display panel includes a first substrate; a second substrate arranged opposite to the first substrate, an array layer formed on the first substrate, a common electrode formed on the second substrate; and the driving circuit 140 as above.

It should be noted that the definition of each step involved in the present solution is not determined to limit the sequence of steps without affecting the implementation of the specific solution, and the steps written in the foregoing may be executed previously, later, or even simultaneously, as long as the present solution can be implemented, the steps should be considered as falling into the scope of protection of this application.

The technical solution of the present application can be widely a twisted nematic (TN) panel, an in-plane switching (IPS) panel, and a multi-domain vertical alignment (MVA) panel, and of course, the panels may also be other types of panels that are applicable.

The above is a detailed description of the present application in connection with the specific optional embodiments, and the specific implementation of the present application is not limited to the description. It will be apparent to those skilled in the art that a plurality of simple deductions or replacements can be made without departing from the conception of the present application, and all be construed as belonging to the scope of the present application.

What is claimed is:

1. A driving method for application in a driving circuit of a display panel, wherein the driving circuit comprises a compensator, an initializer, and a controller, and the driving method includes steps of:

acquiring by the controller, a common voltage at an output terminal of the initializer;

comparing the value of the common voltage with a preset threshold; and compensating for the value of the common voltage according to a comparison result;

wherein the controller comprises:

a standard voltage circuit that provides a reference voltage; and a third switch, wherein a source electrode of the third switch is connected to the standard voltage circuit, and a gate electrode of the third switch collects the common voltage output by the initializer; the drain electrode controls and is connected to the compensator; and the third switch controls the compensator to compensate for the value of the common voltage when the common voltage is less than the reference voltage.

2. A driving circuit, comprising:

an initializer that outputs a common voltage;

a compensator coupled to the initializer; and a controller that collects the common voltage output by the initialize, and controls the compensator to compensate for a value of the common voltage after the common voltage is less than a preset threshold;

wherein the controller comprises:

a standard voltage circuit that provides a reference voltage; and a third switch, wherein a source electrode of the third switch is connected to the standard voltage circuit, and a gate electrode of the third switch collects the common voltage output by the initializer; the drain electrode controls and is connected to the compensator; and the third switch controls the compensator to compensate for the value of h common voltage when the common voltage is less than the reference voltage.

3. The driving circuit according to claim 2, wherein the controller comprises:

a first switch that controls and is connected to the initializer, wherein the first switch controls the initializer to operate normally when the common voltage collected by the controller is at least the preset threshold; and a second switch that controls and is connected to the compensator, wherein the second switch controls the compensator to operate and compensate for the value of the common voltage when the common voltage collected by the controller is less than the preset threshold.

4. The driving circuit according to claim 3, wherein the third switch is configured to control and is connected with the first switch and the second switch.

5. The driving circuit according to claim 4, wherein the drain electrode of the third switch is configured to control and is connected with the first switch and the second switch.

6. The driving circuit according to claim 3, wherein a control terminal of the first switch is negatively conductive and a control terminal of the second switch is positively conductive.

7. The driving circuit according to claim 6, wherein the first switch is an N-MOS tube, and the second switch is a P-MOS tube.

8. The driving circuit according to claim 2, wherein the third switch is configured to control and is connected with a memory and the compensator;

when the common voltage collected by the controller is at least the preset threshold, the third switch controls the initializer to operate normally; and when the common voltage collected by the controller is less than the preset threshold, the third switch controls the compensator to operate so as to compensate for the value of the common voltage.

9. The driving circuit according to claim 2, wherein the standard voltage circuit comprises a first resistor and a second resistor connected in series between a high level supply voltage and a low level voltage, and the source electrode of the third switch is connected between the first resistor and the second resistor; and at least one of the first resistor and the second resistor is an adjustable resistor.

10. The driving circuit according to claim 2, wherein the initializer comprises an initial memory, and the initial memory stores an initial value of the common voltage;

the compensator comprises a compensation memory, and the compensation memory stores a compensation value of the common voltage; and an output terminal of the compensation memory is coupled to an output terminal of the initial memory to compensate for an initial value of the common voltage.

11. The driving circuit according to claim 10, wherein the controller is configured to recognize an offset of the common voltage from the initial value of the common voltage, and if determining that the offset is too large and that the common voltage is too low, the controller is configured to use a compensation signal code with a relatively large value stored in the compensation memory to perform compensation for the value of the common voltage.

12. The driving circuit according to claim 2, wherein the initializer comprises:

an initial memory that stores an initial signal code;

a digital-to-analog converter that converts the initial signal code transmitted from the initial memory into an analog voltage; and an output current amplifier that outputs the common voltage;

wherein the output terminal of the initial memory is coupled to an input terminal of the digital-to-analog converter, and an output terminal of the digital-to-analog converter is coupled to an input terminal of the output current amplifier; an output terminal of the output current amplifier is the output terminal of the initializer;

the compensator comprises:

a compensation memory that stores a compensation signal code;

wherein an output terminal of the compensation memory is coupled to the input terminal of the digital-to-analog converter of the initializer.

13. The driving circuit according to claim 12, wherein the standard voltage circuit comprises a third resistor; one end of the third resistor is connected to the drain electrode of the third switch and the other end thereof is grounded.

14. The driving circuit according to claim 2, wherein the driving circuit comprises a control chip; the initializer, the compensator, the first switch and the second switch are all arranged on the control chip; and the standard voltage circuit, the third resistor, and the third switch are arranged outside the control chip.

15. The driving circuit according to claim 2, wherein a control terminal of the third switch is negatively conductive, the third switch being an N-MOS tube.

16. A display device, comprising a display panel, wherein the display panel comprises:

a first substrate;

a second substrate arranged opposite to the first substrate;

an array layer formed on the first substrate;

a common electrode formed on the second substrate; and a driving circuit, comprising:

an initializer that outputs a common voltage;

a compensator coupled to the initializer; and a controller that collects the common voltage output by the initializer, and controls the compensator to compensate for a value of the common voltage when the common voltage is less than a preset threshold;

wherein the controller comprises a standard voltage circuit that provides a reference voltage; and a third switch, wherein a source electrode of the third switch is connected to the standard voltage circuit, and a gate electrode of the third switch collects the common voltage output from the initializer; the drain electrode controls and is connected to the compensator; and the third switch controls the compensator to compensate for the value of the common voltage when the common voltage is less than the reference voltage.

17. The display device according to claim 16, wherein the controller comprises:

a first switch that controls and is connected to the initializer, wherein the first switch controls the initializer to operate normally when the common voltage collected by the controller is at least the preset threshold;

a second switch that controls and is connected to the compensator, wherein the second switch controls the compensator to operate so as to compensate for the value of the common voltage when the common voltage collected by the controller is less than the preset threshold.

18. The display device according to claim 17, wherein the standard voltage circuit comprises a first resistor and a second resistor; one end of the first resistor is connected to a high level supply voltage, and the other end of the first resistor is connected to one end of the second resistor; the other end of the second resistor is grounded; the source electrode of the third switch is connected between the first resistor and the second resistor; and at least one of the first resistor and the second resistor is an adjustable resistor.

19. The display device according to claim 16, wherein the initializer comprises:

an initial memory that stores an initial signal code of a value of a corresponding initial common voltage;

a digital-to-analog converter that converts the initial signal code transmitted from the initial memory into an analog voltage; and an output current amplifier that outputs the common voltage;

wherein an output terminal of the initial memory is coupled to an input terminal of the digital-to-analog converter, and an output terminal of the digital-to-analog converter is coupled to an input terminal of the output current amplifier; an output terminal of the output current amplifier is the output terminal of the initializer;

the compensator comprises:

a compensation memory that stores a compensation signal code of the common voltage;

wherein an output terminal of the compensation memory is coupled to an input terminal of the digital-to-analog converter of the initializer.

* * * * *